US007476023B1

(12) United States Patent
Canfield et al.

(10) Patent No.: US 7,476,023 B1
(45) Date of Patent: Jan. 13, 2009

(54) MULTIPLE ENERGY X-RAY SOURCE ASSEMBLY

(75) Inventors: Bradley Dee Canfield, Orem, UT (US); James R. Boye, Salt Lake City, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 12 days.

(21) Appl. No.: 11/460,581

(22) Filed: Jul. 27, 2006

(51) Int. Cl.
*H01J 35/16* (2006.01)

(52) U.S. Cl. ..... 378/203; 378/9

(58) Field of Classification Search ..... 378/9, 378/92, 203
See application file for complete search history.

(56) References Cited

U.S. PATENT DOCUMENTS 7,012,989 B2 * 3/2006 Holland et al. ..... 378/124

* cited by examiner

*Primary Examiner*—Chih-Cheng G Kao
(74) *Attorney, Agent, or Firm*—Workman Nydegger

(57) ABSTRACT

A multiple energy x-ray source device is disclosed. Embodiments include a dual x-ray source comprised of two x-ray tubes mounted in separate housings. Each x-ray tube operates at a different power level, and each produces a characteristic x-ray signal. The x-ray sources are mounted on a common support structure, and are adjustable with respect to one another and with respect to the support structure so as to provide the ability to precisely align the focal spot of the x-ray signal emitted by each. Interconnection of the x-ray sources is provided by way of interlocking beam shields affixed to each source.

20 Claims, 5 Drawing Sheets

MULTIPLE ENERGY X-RAY SOURCE ASSEMBLY

BACKGROUND

X-ray generating devices are often used to produce x-ray signals that can be used to generate images of a device or patient. For example, x-rays are commonly used by baggage screening systems to evaluate the contents of baggage and the like. In this type of application, an x-ray source is typically mounted on a rotating gantry. A belt or conveyer carrying an object to be scanned is passed through the gantry. The x-ray source emits an x-ray signal that penetrates the object, and is then detected by an x-ray detector. This can then be used to construct an image of the object.

Typical inspection gantries of this sort use a single energy tube source in a single pass configuration. To penetrate objects appropriately, the x-ray source is typically operated at a higher energy level. However, at this higher level, softer objects are not well detected—this can result in missed positives. This is often unacceptable, especially when security is a concern. To address this problem, objects can be scanned again at a lower energy level. The different images can then be manually correlated for detection and confirmation of findings.

However, this approach requires that an operator perform multiple passes and scans of a given object to insure that the contents have been properly assessed. In particular, switching between multiple energies on a single energy gantry requires the scan to be completed, the power supply switched off, and then re-energized at the new level before the object is scanned again. In a baggage screening operation, this can be very time consuming and costly. Moreover, switching to a different energy while the x-ray source is under power can cause equipment destruction due to the amount of power being switched under load.

Hence, it would be desirable to provide an x-ray detection system that can simultaneously produce multiple x-ray signals having different energy levels, and thereby detect objects having different densities/characteristics.

The subject matter claimed herein is not limited to embodiments that solve any disadvantages or that operate only in environments such as those described above. Rather, this background is only provided to disclose one exemplary technology area where some embodiments described herein may be practiced.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Embodiments of the present invention relate to a multiple energy x-ray source assembly. Embodiments of the multiple energy x-ray source are particularly useful for imaging applications that require multiple energy x-ray scans to adequately penetrate objects of different densities. By interleaving the imaging of the two x-ray sources, the data contained in a given image will allow for more accurate images of objects having varying densities. This greatly increases the image's utility for detecting and distinguishing, for example, the contents of the objects being scanned. The approach minimizes so-called false positives, reduces the need for multiple scans of a given object and saves costs by eliminating the need for additional scanner equipment and/or scanning time.

In one embodiment, the multiple energy x-ray source is implemented as a dual energy x-ray source configured with two separate x-ray tube sources. The x-ray tube sources can be mounted to a rotating gantry (for example) via a mounting structure. Each of the tubes can be configured to generate x-ray signals at different operating levels. Passing through the center of the gantry is a conveyor belt (or a similar apparatus), which would carry the item of interest, such as baggage. Disposed on the gantry at a side opposite of the dual energy source is a suitable imaging device.

The mounting structure provides a common platform to which the housings of the x-ray sources are mounted and aligned. Preferably, the focal spots in the assembly are aligned to the mounting plate in a manner to match the helical path created by the gantry's rotation and the motion of an object through the center of the gantry via a conveyor belt or similar apparatus. The alignment is provided in a manner so as to correctly and precisely set the overlap of the assembly's x-ray beams and thereby assure that the gantry image detectors are fully covered by each beam. Moreover, this alignment allows interleaving of the two beams in a predictable manner so as to produce image data at the two energy levels of the same slice of the object being scanned. This data can be time correlated and analyzed so as to produce a useful image for use by the system operator. Hence, in a single pass, image data can be obtained of items having different densities (for example, the contents of a suitcase).

In a preferred embodiment, each of the x-ray sources is positioned with respect to one another and the mounting structure so as to insure that the two beams are correctly interleaved. This positioning is provided by way of an interlocking mechanism, which also permits adjustment of one source with respect to the other, as well as the mounting structure. This insures correct beam alignment, and also allows proper configuration for different gantry types or other operating configurations.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are disclosed in the appended drawings. Understanding that these drawings depict only typical embodiments and are not therefore to be considered to be limiting in scope, embodiments will be described and explained with additional specificity and detail through the use of the accompanying drawings in which.

DETAILED DESCRIPTION OF EXAMPLE EMBODIMENTS

Figure 1:
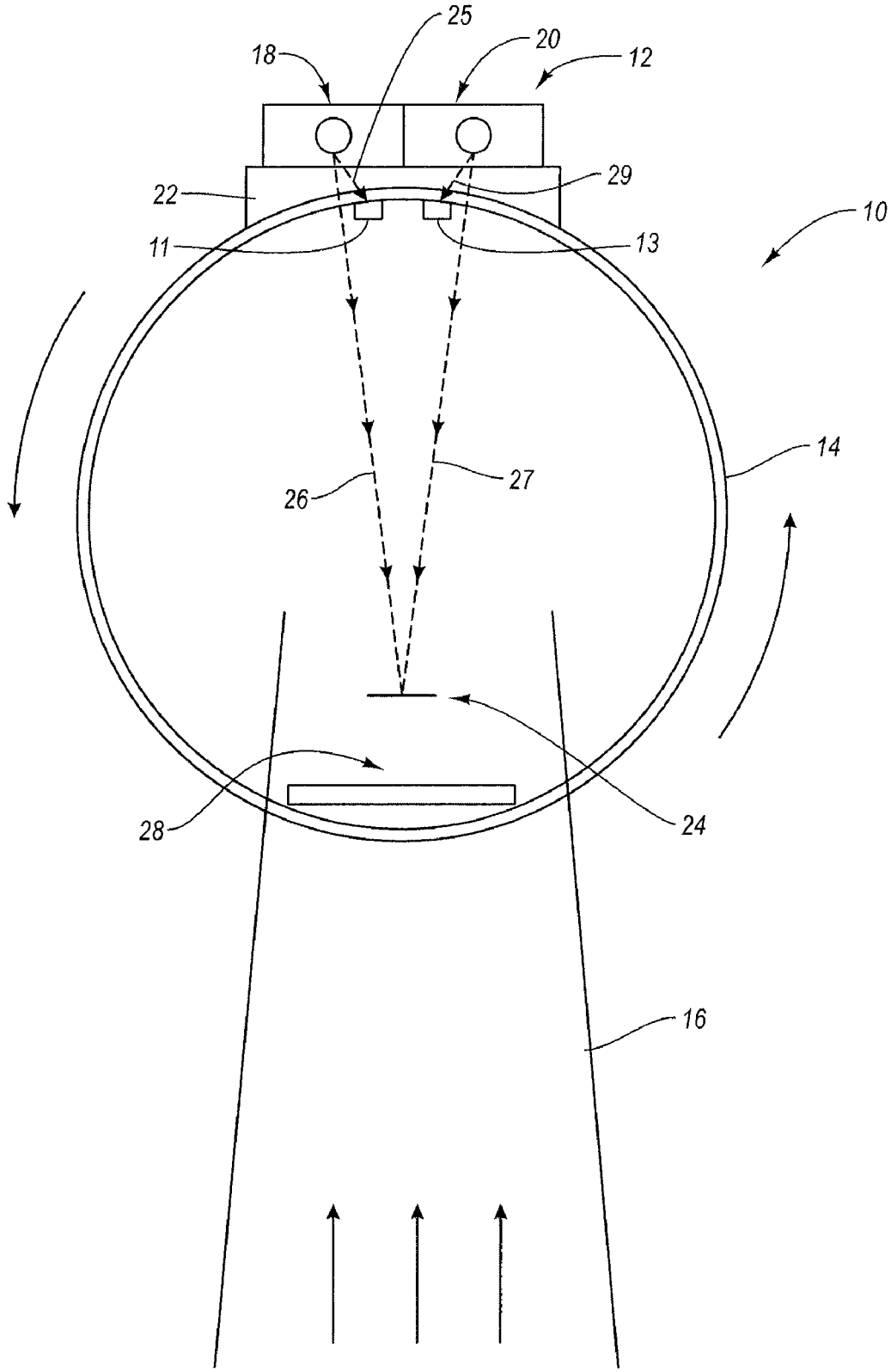
FIG. 1 discloses an overview of an example rotating gantry system having an example dual tube x-ray source assembly mounted thereon.

As noted above, example embodiments of the invention relate to a multiple energy x-ray source assembly. Embodiments of the multiple energy x-ray source are particularly useful for imaging applications that require multiple energy x-ray scans to adequately penetrate objects of different densities. For example, in one embodiment, described further below, a dual energy x-ray source is mounted on a gantry for x-ray inspection of items, such as baggage inspection for security purposes. In this type of environment, one of the x-ray sources might operate at one energy level—chosen, for example, to penetrate denser/harder objects—and the other x-ray source at a lower energy level—chosen, for example, to penetrate less dense/softer objects. By interleaving the imaging of the two x-ray sources, the data contained in a given image will allow for more accurate images of objects having varying densities. This greatly increases the image's utility for detecting and distinguishing the contents of the objects being scanned—which can be of critical importance in security applications. The approach minimizes so-called false positives, reduces the need for multiple scans of a given object and saves costs by eliminating the need for additional scanner equipment and/or scanning time.

I. Example Gantry System Utilizing a Dual Energy X-Ray Source

While examples of the multiple energy x-ray source described herein could be used in a variety of environments and applications, one particularly useful scenario is for the device to be mounted to a gantry/conveyor system to scan items, such as luggage. One example of a baggage inspection gantry is designated generally at 10 and schematically represented in FIG. 1, to which reference is now made.

In this example, the multiple energy x-ray source is implemented as a dual energy x-ray source assembly, denoted at 12. As will be described further below, the dual energy source assembly 12 is configured with two separate x-ray sources, denoted at 18 and 20 respectively, which are mounted to a rotating gantry 14. Passing through the center of the gantry is a conveyor belt 16 (or similar apparatus), which would carry the item of interest, such as baggage. Disposed on the gantry 14 at a side opposite of the dual energy source assembly 12 is a suitable imaging device, designated at 28. Of course, performance of the multiple energy x-ray source implementation is independent of detector type, which can be in the form of any x-ray sensitive material so as to produce the x-ray image. However, in a preferred embodiment, the detector would be in the form of a digital detector, such as a solid state flat panel x-ray detector that is operatively connected to a suitable display device (not shown) for use by a system operator. Moreover, it will be appreciated that the configuration could work with cone beam CT applications, as well as with traditional CT application environments.

In the example shown, the two x-ray sources 18, 20 are together mounted to a rotating gantry 14 via a gantry mounting plate 22. As will also be described in further detail, in a preferred embodiment each of the x-ray sources 18, 20 are configured to generate x-ray signals at different operating voltages. For example, source 18 might be configured to operate at 90 kV, while source 20 might be configured to operate at 180 kV. Of course, different operating voltages are also contemplated, depending on the needs of a given application. The resultant x-ray signals, referred to as a "primary" x-ray beam (denoted at 26 and 27) would thus result in x-ray images having different characteristics: the higher power source would be able to penetrate denser materials, while the lower power source would be able to penetrate and detect relatively softer materials.

As will also be discussed further, in the illustrated embodiment each x-ray source 18 and 20 is also configured with respect to the gantry 14 to provide a "reference" x-ray beam. The reference beam, denoted in FIG. 1 at 25 and 29, impinges on a reference detector, denoted at 11 and 13. The reference beam and detector can be used in the system to time correlate data and allow an operator to insure that x-ray signals are present when desired.

As will be described further, the mounting plate 22 provides a common platform to which the housings of the x-ray sources 18, 20 are mounted and aligned. Preferably, the focal spots in the assembly 12 are aligned to the mounting plate 22 in a manner to match the helical path created by the gantry's rotation and the motion of an object through the center of the gantry via a conveyor belt (denoted at 16) or similar apparatus. The alignment is provided in a manner so as to correctly and precisely set the overlap of the assembly's 12 x-ray beams 26, 27 and thereby assure that the gantry image detectors 28 are fully covered by each beam. Moreover, this alignment allows interleaving of the two beams 26 and 27 in a predictable manner so as to produce image data at the two energy levels of the same slice 24 of the object being scanned. This data can be time correlated (i.e., depending on the speed of the conveyor belt 16 and the rotational speed of the gantry 14) and analyzed so as to produce a useful image for use by the system operator. Hence, in a single pass, image data can be obtained of items having different densities (for example, the contents of a suitcase).

II. Example Dual Energy X-ray Source

Figure 2:
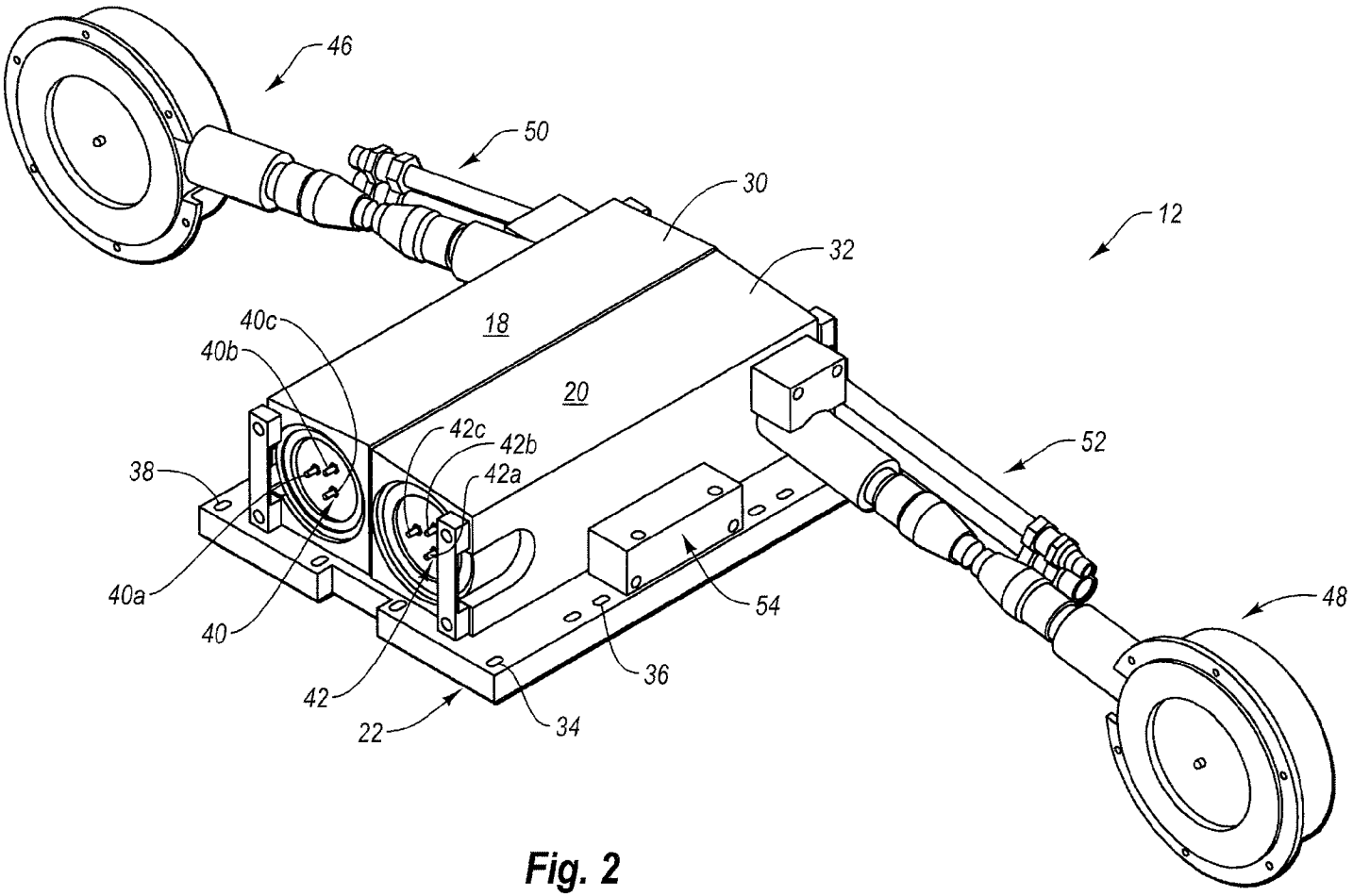
FIG. 2 discloses a perspective view of one example of a dual tube x-ray source assembly.

Referring now to FIG. 2, a perspective view of an example of a dual energy x-ray source assembly, designated at 12, is shown. In this particular example, two x-ray sources 18 and 20 are shown. However, the present invention is not necessarily limited to two sources and, depending on the needs of a particular application, could include three or more. In the illustrated embodiment, each of the x-ray sources is configured as an x-ray tube having a stationary anode. Further details will be provided below. Each x-ray tube is disposed within its own housing, designated respectively at 30 (enclosing x-ray tube for source 18) and 32 (enclosing x-ray tube for source 20). The housings 30, 32 are comprised of a suitable metal, such as aluminum, and are preferably designed symmetrically so that one design can function for both the left and the right configuration.

Each of the housings is positioned with respect to the mounting plate 22 in a manner that is described in further detail below. As noted, the mounting plate 22, also preferably comprised of a suitable metal material such as aluminum, provides a common platform to which the housed x-ray tubes are mounted and aligned. The focal spots in the assembly are preferably aligned to the plate 22 features in a manner to match the helical path (pitch) created by the gantry's rotation and the motion of an object through the center on the gantry 14 via a conveyor belt or similar apparatus. This alignment allows interleaving of the two primary beams (26 and 27 in FIG. 1) in a predictable manner, which results in image data at two energy levels of the same slice (24 in FIG. 1) of the object being scanned. This data can then be time correlated and analyzed accordingly so as to produce a suitable image, i.e., allowing simultaneous analysis of the contents of the object at both energy levels. Preferably, bolt patterns (denoted at 34, 36, 38—for example) in the plate 22 are positioned and designed to match the specific gantry. Each x-ray source housing is then positioned on the mounting plate so as to produce the two primary x-ray beams (26 and 27 in FIG. 1) that are appropriately aligned to the pitch of the particular gantry 14 (FIG. 1). In one embodiment, adjustment is provided to allow alignment of the two beams to reference points on the plate. Again, proper alignment correctly and precisely sets the overlap of the assembly's x-ray beams to insure that the gantry image detectors are fully covered by each beam. Hence, depending on the configuration of the gantry and other factors, one x-ray source may be offset slightly with respect to the other x-ray source. For example, while not easily discernable from the drawing, housing 32 is offset slightly along its length with respect to housing 30 so as to achieve a desired alignment vis-à-vis the two primary x-ray signals. Details regarding one approach for providing this alignment will be provided below.

As will be shown and described in subsequent drawings, the mounting plate 22 is provided with appropriate openings to permit the primary x-ray signals (26 and 27 in FIG. 1) to pass to the interior portion of the gantry (typically with a collimator disposed in the path—not shown) and to the object being scanned. In addition, openings are also provided so as to allow the passage of the reference beams 25 and 29 to corresponding reference detectors 11, 13.

Also shown in FIG. 2 is a portion of each cathode assembly, denoted at 40 and 42, for each x-ray source 18 and 20. Also shown are the electrical connectors (40*a,b,c* and 42*a,b,c*) associated with each cathode assembly that provide for electrical attachment to an appropriate power supply (not shown), including cathode potential and current for the respective cathode filaments (described below). While different electrical arrangements and potentials could be used, in preferred embodiments the cathode assembly of each tube assembly is held at ground potential during operation, and each is grid capable. The grid capability allows the generation of x-rays to be turned on and off as part of the beam interleaving. In a preferred embodiment, each x-ray source is driven at the same frequency, but is alternately turned on and off. The grid signal and voltage are provided by the gantry and are designed to match the data acquisition requirements of the gantry. Also, with the cathode of the source at ground, the power in the circuit which must be switched on and off is minimized. As a result, the switching can occur at kHz frequencies and higher. This allows for higher scan rates while producing improved image data with the two energy levels of images.

Not visible in FIG. 2 is the anode assembly of each x-ray source, which will be described in further detail below in connection with FIG. 3. Again, while different electrical configurations could be used depending on the type of tubes used, in illustrated embodiments each anode connection is at a high voltage, depending on the power requirements of the given tube (for example, 90 kV and 180 kV). This provides the voltage differential and target for generating x-rays. The high voltage for each anode is provided by way of the high voltage cable assemblies, designated at 46 and 48, which are each connected to the appropriate power supply (not shown) of the gantry.

Also shown in FIG. 2 are two pairs of fluid connection ports, designated at 50 and 52 respectively. Each pair of ports provides an inlet port and an outlet port. The inlet port for supplying a coolant to the corresponding x-ray tube, and the outlet port for retrieving heated coolant from the tube. The coolant is preferably circulated through a heat exchanger (not shown) and then reintroduced to the tube. One example of the use of a coolant within the tube environment is described below in connection with FIG. 3.

Also illustrated in FIG. 2 is a side scatter shield 54 associated with source 20 (a similar scatter shield is provided for the other source 18, but is not visible in FIG. 2). The side scatter shield 54 is comprised of a suitable x-ray attenuating material, such as leaded brass, and is positioned so as to eliminate, or at least minimize, any stray radiation from exiting the assembly 12. As will be shown further, the side scatter shield is positioned along the housing 32 at a point adjacent to the x-ray window in the tube disposed within the housing, so as to confine any back scatter radiation from being emitted.

Figure 3:
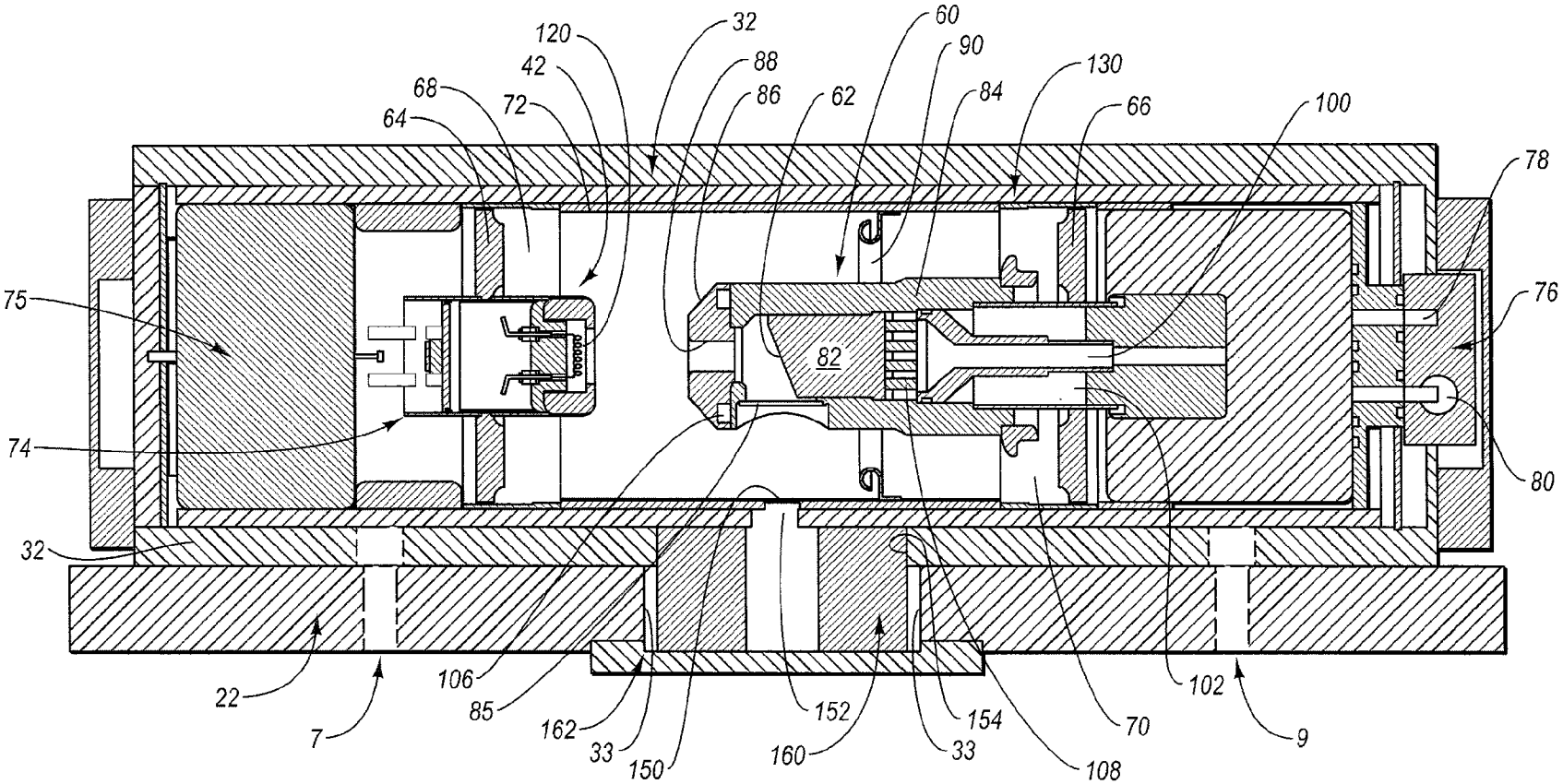
FIG. 3 shows a cross-sectional view of one of the x-ray tubes of FIG. 2.
Figure 4:
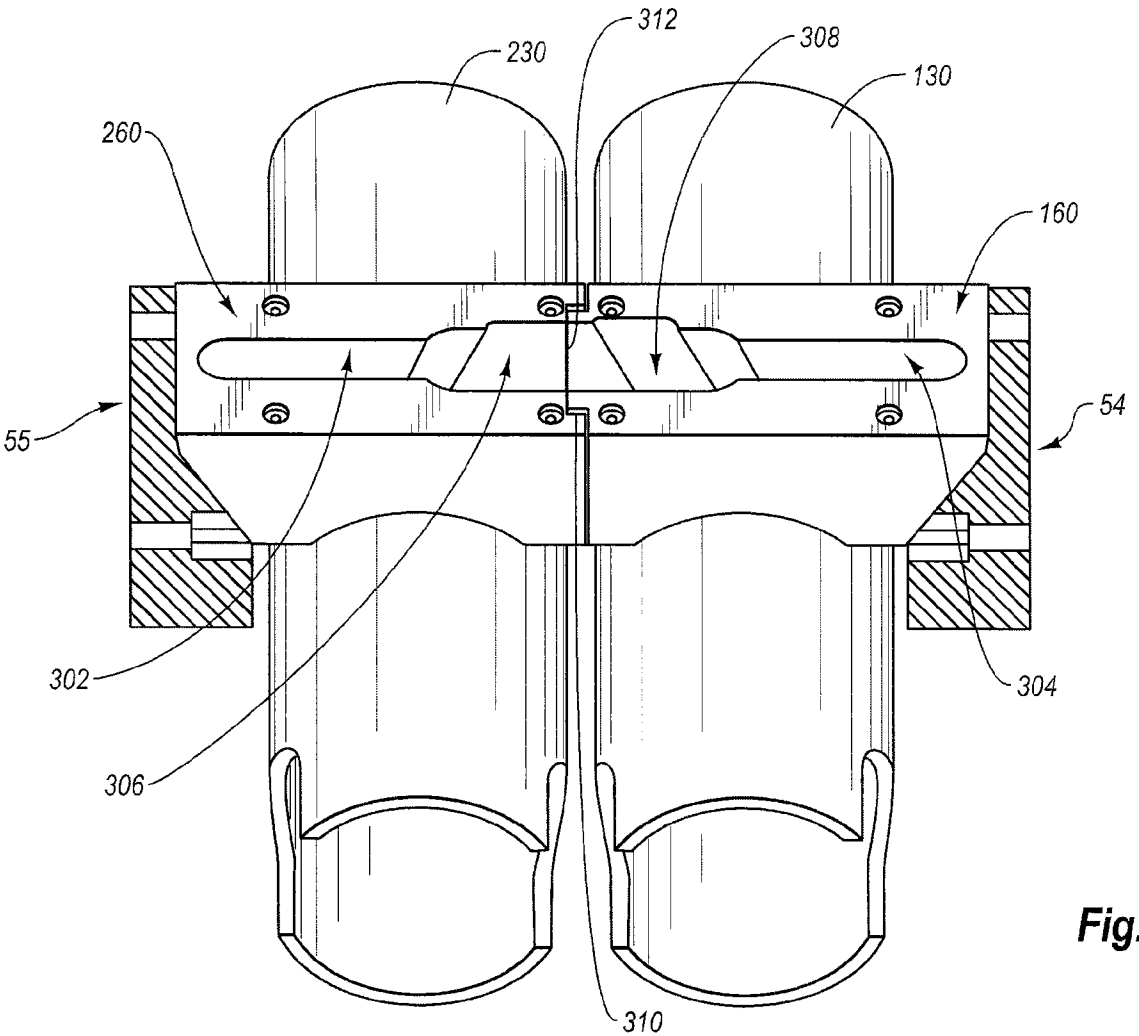
FIG. 4 is a perspective view showing details of one example of the interlocking relationship between two x-ray sources.
Figure 5:
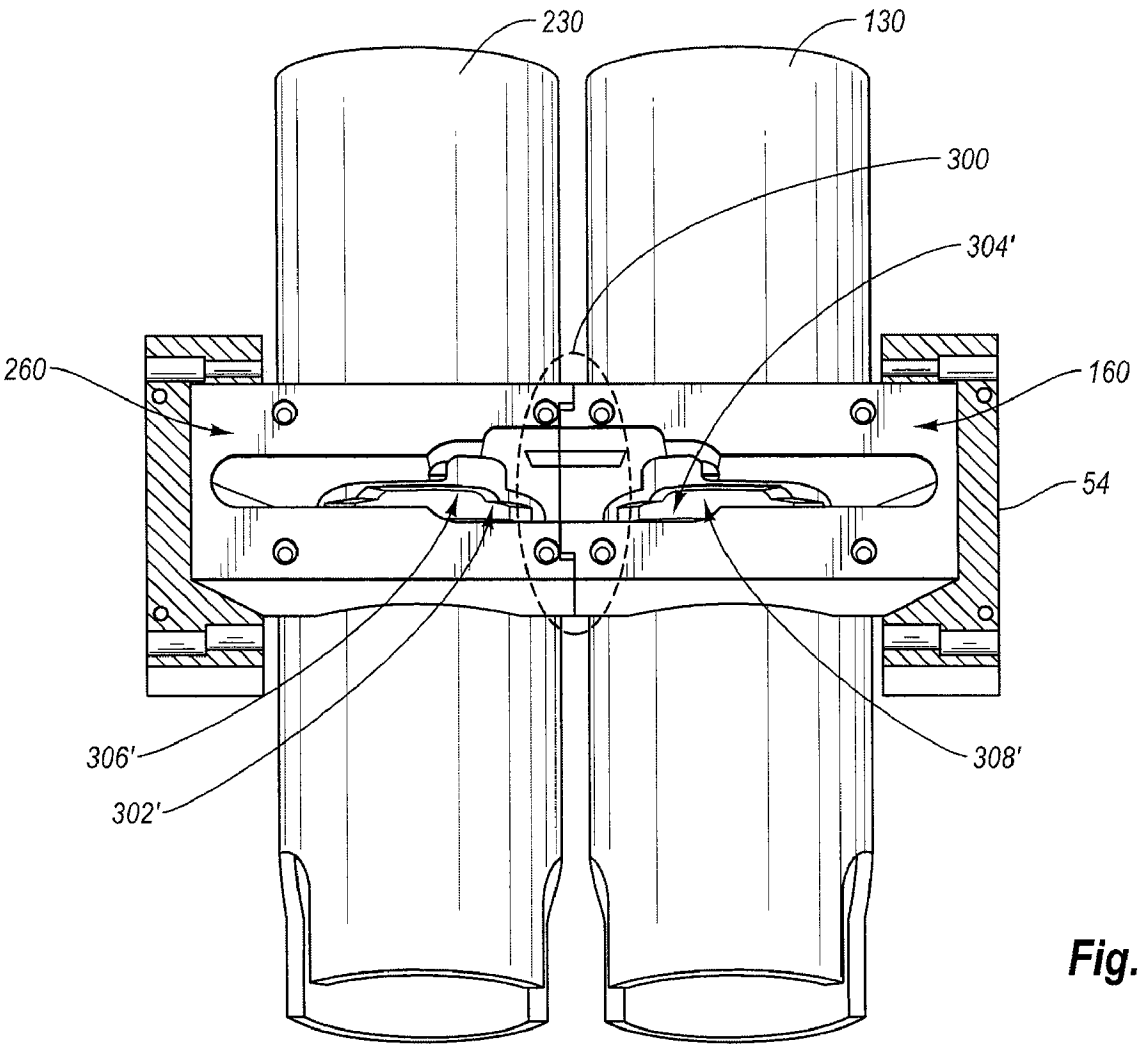
FIG. 5 is another view showing details of the interlocking relationship between two x-ray sources.

Reference is next made to FIG. 3 along with FIGS. 4-5, which together illustrate additional details regarding the example dual x-ray tube assembly.

FIG. 3 shows by way of a cross section view, details of one example of an x-ray source that can be used for the generation of x-rays. In the illustrated example, the x-ray source is but one example of a fixed anode type x-ray tube. However, it will be appreciated that any one of a number of different types of x-ray tube configurations could be used depending on various design objectives and the needs of a particular application. Moreover, the x-ray source could also be of the rotating anode type of x-ray tube. Also, for purposes of convenience, FIG. 3 is used to describe only one of the single x-ray sources of the dual x-ray tube assembly. The details apply equally to the other x-ray source in the dual assembly.

As is shown in FIG. 3, the x-ray source is disposed within the outer housing (here, 32) and is comprised of an x-ray tube having a cathode assembly 42 and an anode assembly 60. The cathode 42 and the anode 60 are both disposed within an evacuated enclosure, formed here via two end ceramic portions 64, 66 encased in respective collar portions 68 and 70 (constructed of Kovar or any other suitable material), and a cylindrical stainless steel housing 72. Each ceramic end portion 64, 66 also include an appropriate receptacle portion for receiving the electrical power for the corresponding assembly. Hence, ceramic end 64 includes a receptacle 74 for interfacing with an appropriate electrical connector to the cathode connectors 42*a,b,c* (FIG. 2) and ceramic end 66 includes a receptacle for interfacing with an appropriate electrical connector to the anode high voltage cable 48 (FIG. 2). Also, in the illustrated embodiment, the anode receptacle end 76 also provides an interface for a fluid inlet port 78 and fluid outlet port 80 that interface with the fluid connection 52 (FIG. 2), also by way of a suitable connector.

As noted above, the x-ray tube is of a fixed anode type x-ray tube, and thus the anode assembly 60 includes a fixed target anode surface, denoted at 62. In the example embodiment, the main body of the anode 82 is constructed of copper or copper alloy, and the target anode surface 62 of tungsten or other similar material. The anode assembly 60 includes a copper support structure 84, which is supported by end portion 70. One end of the support structure 84 includes an aperture shield portion 86, which includes an aperture 88 that allows electrons emitted by the cathode assembly 42 to pass to the anode surface 62. Disposed about the anode support structure 84 is a shield 90, which can also be constructed of copper and the like, and is positioned to intercept and block stray electrons. It also may be configured and positioned so as to provide some electric field shaping functions.

Formed in a side of the support structure 84 is an x-ray window 85. Some of the energy released due to the electrons striking the target surface 62 results in the production of x-rays in a manner that is well known. The angled position of the target surface 62 causes a majority of these x-rays to be emitted in the direction of the window 85 and for subsequent emission from the tube assembly.

Much of the kinetic energy from electrons striking the anode surface is released in the form of heat. In the example embodiment, the x-ray source includes cooling features to insure that the structure—especially in the region of the anode—does not overheat during operation. For example, fluid channels are provided in the region of the anode target surface, including in the main body portion 82, the support structure 84 and the aperture shield portion 86 to allow the flow of coolant during operation in these regions so as to enhance the removal of heat. Coolant is circulated via the fluid connections 52 (FIG. 2), and cooled via an external heat exchanger (not shown). Coolant is supplied via fluid connections 52 via the anode receptacle 76 and the corresponding inlet 78 and outlet 80 via an appropriate connector. Preferably, the fluid path between the connector and the anode assembly 60 is helical in nature (not visible in FIG. 3) so as to provide a larger fluid path and, due to the electrical isolation characteristics of the coolant, a larger insulating standoff between the high voltage anode connector and the grounded portions of the tube.

As is shown in the example, a fluid-in 100 and fluid-out 102 interface path with the flow channels of the anode assembly is provided. Coolant is supplied to the channels (one of which is visible in the aperture 86 at 106) via a plurality of fluid ports 108 into the base of main body portion 82 of anode. Coolant is then circulated throughout appropriate areas of the anode to absorb heat, and then exited out through fluid-out port 102 to exit the tube via connector and fluid outlet 80.

In an example embodiment, a silicone based thermal fluid is used as a coolant. One option is Dow Sylthern HF, although any one of a number of similar types of silicone fluids could be used. Any other type of coolant exhibiting satisfactory coolant and electrical isolation characteristics could also be used. One advantage of a silicone-based coolant is that heat does not break it down and, since it is not carbon-based, no carbon particles are generated. This eliminates the need for a filter in the heat exchanger, which reduces complexity and cost in the overall system.

The cathode assembly 42 is supported by end portion 68 with respect to the anode assembly 60. Cathode assembly 42 includes a filament 120 for thermionic emission of electrons in a manner that is well known. Electrical current and voltage is provided to the filament via the cathode receptacle 74. In one embodiment, electrical connections to the cathode assembly 42 (via the cathode receptacle 74) are made through a radiation shielding connection scheme, denoted in the region 75, which prevents radiation leakage through the region of the cathode receptacle 74. Since in the illustrated embodiment the cathode is not at a high voltage (substantially ground), the connector region 75 is preferably made from an insulating compound that is filled with x-ray attenuating material. For example, bismuth trioxide in an epoxy can be used. Alternatively, epoxy (or other potting compounds such as urethane) filled with lead or tungsten powder and the like, could also be used.

As noted, the x-ray tube assembly is disposed within outer housing 32. In the illustrated embodiment, the inner surface of housing 32 is lined with a shielding layer 130, comprised of lead or a similar x-ray blocking material. In the illustrated embodiment the housing shielding runs the length of the housing so as to prevent the emission of any off-focus/secondary radiation leakage. The lining is also designed symmetrically so that it can be used in the housing on either side.

As noted above, as electrons are emitted from the cathode filament 120, they accelerate towards the anode target 62 due to the large voltage potential established between the anode and the cathode. The electrons strike the surface of the anode target 62 and at least some of the resulting kinetic energy produces x-rays. The characteristic of the resulting x-ray signal is dependent partially on the operating voltage of the tube. In an example implementation, each tube is operated at a different operating voltage, for example 90 kV and 180 kV. Hence, each tube produces different characteristic x-rays. As noted, a majority of these x-rays exit window 85. Further, housing 72 includes an x-ray transmissive window, denoted at 150, and shielding layer 130 includes an opening, denoted at 152, to permit the exit of a primary and reference x-ray signal. An opening 154 is also provided in the housing 32. Disposed within this opening is an interlocking beam shield, designated generally at 160, which functions to align the x-ray source with the other x-ray source in the dual configuration, and is also used to align the x-ray source with respect to the mounting plate 22, as will be shown and described below.

FIG. 3 further illustrates some details regarding the mounting of the x-ray source 20 to the mounting plate 22. As previously noted, housing 32 (and housing 30) is positioned with respect to the mounting plate 22. In preferred embodiments, interface to the gantry via the mounting plate is provided in a manner that allows movement of the two x-ray sources independently so as to achieve a desired alignment. However, movement of the x-ray sources is provided in a way that does not result in any openings that would allow x-ray leakage or scatter back through the assembly via secondary x-ray sources. In one illustrated embodiment, this alignment and movement is facilitated by way of an interlocking beam shield, denoted at 160 and a collar shield 162. While other materials would suffice to provide sufficient x-ray containment, in one embodiment the beam shield is comprised of a leaded brass material, and the collar shield 162 of lead. The collar shield 162 allows primary and reference beams to enter a collimator of a gantry, while preventing back scatter radiation from going up into any openings that are left around the interlocking beam shields of each x-ray source.

Reference is next made to FIGS. 3-5, which together illustrate additional details regarding the interlocking beam shield in the dual source assembly. First, FIG. 3 shows how the interlocking beam shield, which is affixed to the housing 32, fits within a recess 33 formed in the mounting plate 22. The dimensions of the recess are larger that the size of the outer periphery of the beam shield 160 so that the beam shield can be moved and positioned as desired within the recess (and thus the housing 32). This allows for the correct positioning of a respective housing so as to achieve correct beam alignment. Once a correct alignment is achieved, slotted mounting holes (represented, for example at 7, 9 for purposes of illustration) within the mounting plate and the housing 32 allow for the housing to be permanently affixed to the plate.

FIGS. 4 and 5 show a view of the interlocking nature provided by the interlocking beam shields 160 and 260 so that one housing can be correctly positioned with respect to another. For ease of description, only the housing shield portion of each x-ray source is shown, 130 and 230. As noted above in connection with FIG. 3, the interlocking beam shields 260, 160 are attached directly to their corresponding housings 30, 32 so that they are able to move with the housings during alignment. Moreover, an opening is provided in the mounting plate 22 (designated at 33 in FIG. 3) that is large enough to allow the full range of adjustment for the alignment procedure via the interlocking beam shields. Again, the collar shield 162 (FIG. 3) and the side scatter shield (54 and 55) prevents the leakage of radiation through any gaps left via the mounting plate opening after adjustment.

In a preferred embodiment, the interlocking beam shields 160, 260 provide a means for adjusting the position of one shield with respect to another shield. In one example, this function is provided by way of a male/female engagement relationship. While any one of a number of different engagement mechanisms could be used, the example in FIGS. 4 and 5 shows how beam shield 160 has a male portion 312 that can be moveably received within a corresponding portion defined by beam shield 260 at 310. As is shown, the size of female receptacle is large enough to permit lateral movement of beam shield 160 with respect to shield 260.

Also visible in FIGS. 4 and 5 are how the beam shields 160, 260 each provide a primary x-ray beam opening, denoted at 304 and 302, and a reference beam opening, denoted at 308 and 306. Moreover, as can be seen in FIG. 5, these openings correspond to primary and reference beam openings provided in the shield 130, 230. Again, these openings can be sized, shaped and oriented as needed to provide necessary x-ray emission patterns.

As will be appreciated, the shielding between housings 30, 32 is important since a gap can exist between the two housings when mounted on the plate 22—depending on the alignment and relationship between the two. Any radiation that is back scattered toward the source would thus have a direct line out to the world through the gantry shroud (not shown) where operators might be stationed. To allow independent movement during alignment, and still insure shielding through the plate to the gantry collimator and between the housings themselves, the interlocking design with beam paths designed to match the required coverage for both the primary and reference beams is provided as described above. Again, FIGS. 3-5 illustrate how the interlocking shields 260 and 160 are attached to the individual housings 30, 32 so as to completely overlap the beam openings in the housing shielding 230, 130.

The region highlighted at 300 in FIG. 5 shows the interlocking region of the shields 260 and 160. Again, the shields are made from a suitable x-ray attenuating material, such as brass or lead infused brass; of course, the material can vary depending on the space available and the energy of the radiation to be attenuated. FIG. 5 also illustrates openings in the housing shields 130 and 230 for the primary (304' in housing shield 130 and 302' in housing shield 230) and the reference beams (308' in housing shield 130 and 306' in housing shield 230 respectively), the corresponding overlap of the beam shields (and their respective primary and reference openings) and the adjustment permitted by the shielding design.

While the above discussion has illustrated embodiments of the invention in the context of a baggage inspection system, it will be appreciated that the same principals could be used in other operating environments, including a medical gantry, to obtain similar benefits and advantages. For example, the same alignment to the gantry pitch could be performed in a medical context, and the dual energy assembly could be tuned to enhance detection of specific material densities in combination, such as soft tissue structures and bones. Configurations might also have applicability in non-destructive test applications and the like.

Moreover, it will be appreciated that the described assembly does not necessarily have to be rotated by a gantry. It could instead be rotated by a robot or other similar mechanism. Also, the object under examination could be transported through the gantry by a bed, conveyor or similar mechanism. Alternatively, the gantry or scanner could be moved along the object as the source/detector combination is rotated about the stationary object. As long as the relationship between the sources and the detector(s) is known and maintained in a predictable manner, the advantages of the invention can be realized.

In summary, embodiments of the present invention are directed to an apparatus and system wherein multiple energy x-ray sources can be used to more efficiently and effectively produce images of objects having varying densities. For example, a dual energy x-ray source can be operated at two operating powers, thereby producing x-ray signals having different characteristics that can penetrate (and thus produce images of) objects of different densities. The configuration proposed provides the ability to easily adjust one source with respect to another so as to provide the optimal alignment of multiple x-ray signals. The adjustability also allows for easy adaptability to different operating environments, such as a rotating gantry and the like. Hence, with dual energy beams interleaved over the same scan path, data obtained in a single pass over the object is sufficiently rich to detect the full range of materials which might be of interest—such as a baggage security inspector; hard and soft objects are equally well analyzed at the same time. Moreover, the energies of the beams can be optimized to detect the full range of materials desired.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A multiple energy x-ray source assembly comprising:

a support structure having an aperture formed therein;

a first x-ray generating source comprising a first cathode and a first anode positioned within a first evacuated enclosure, the first x-ray generating source mounted on the support structure and configured to emit a first primary x-ray signal through the aperture along a first predetermined path and having a first predetermined energy level;

a second x-ray generating source comprising a second cathode and a second anode positioned within a second evacuated enclosure, the second x-ray generating source mounted on the support structure and configured to emit a second primary x-ray signal through the aperture along a second predetermined path and having a second predetermined energy level; and first and second interlocking beam shields configured to position the first x-ray generating source with respect to the second x-ray generating source on the support structure such that the position of the first source and the second source are adjustable with respect to one another.

2. The assembly as recited in claim 1, wherein:

the first x-ray generating source is further configured to emit a first reference x-ray through the aperture; and the second x-ray generating source is further configured to emit a second reference x-ray signal through the aperture.

3. The assembly as recited in claim 1, wherein:

the first x-ray generating source comprises a first x-ray tube;

the first anode comprises a first stationary anode;

the second x-ray generating sources comprises a second x-ray tube; and the first anode comprises a second stationary anode.

4. The assembly as recited in claim 1, wherein:

the first x-ray generating source further comprises a first coolant fluid inlet port connected to a first coolant fluid outlet port and configured to circulate coolant through at least a portion of the first anode; and the second x-ray generating source further comprises a second coolant fluid inlet port connected to a second coolant fluid outlet port and configured to circulate coolant through at least a portion of the second anode.

5. The assembly as recited in claim 1, further comprising:

a first side scatter shield associated with the first x-ray generating source and configured to reduce any stray radiation from exiting the first x-ray generating source; and a second side scatter shield associated with the second x-ray generating source and configured to reduce any stray radiation from exiting the second x-ray generating source.

6. The assembly as recited in claim 1, wherein:

the first anode comprises a first body comprising copper and a first target anode surface comprising tungsten; and the second anode comprises a second body comprising copper and a second target anode surface comprising tungsten.

7. A multiple energy x-ray source assembly comprising:

a mounting plate having an aperture formed therein;

a first x-ray tube comprising a first cathode and a first anode positioned within a first evacuated enclosure, the first x-ray tube mounted on the mounting plate and configured to emit a first primary x-ray signal through the aperture along a first predetermined path and having a first predetermined energy level;

a second x-ray tube comprising a second cathode and a second anode positioned within a second evacuated enclosure, the second x-ray tube mounted on the mounting plate and configured to emit a second primary x-ray signal through the aperture along a second predetermined path and having a second predetermined energy level; and first and second interlocking beam shields each comprising means for adjusting the position of the interlocking beam shield with respect to the other interlocking beam shield.

8. The assembly as recited in claim 7, wherein:

the means for adjusting of the first interlocking beam shield comprises a male portion; and the means for adjusting of the second interlocking beam shield comprises a female portion configured to removably receive the male portion.

9. The assembly as recited in claim 8, wherein the female portion is configured to allow lateral movement of the first interlocking beam shield with respect to the second interlocking beam shield.

10. The assembly as recited in claim 7, wherein:

the first x-ray tube is further configured to emit a first reference x-ray through the aperture; and the second x-ray tube is further configured to emit a second reference x-ray signal through the aperture.

11. The assembly as recited in claim 10, wherein each of the interlocking beam shields further comprises a primary x-ray beam opening and a reference beam opening.

12. A multiple energy x-ray source system comprising:

a rotatable gantry;

an x-ray detector at least partially positioned within the rotatable gantry; and a multiple energy x-ray source assembly, the multiple energy x-ray source assembly comprising:

a gantry mounting plate mounted to the rotatable gantry, the mounting plate having an aperture formed therein;

a first x-ray tube comprising a first cathode and a first anode positioned within a first evacuated enclosure, the first x-ray tube mounted on the mounting plate and configured to emit a first primary x-ray signal into the gantry through the aperture along a first predetermined path and having a first predetermined energy level;

a second x-ray tube comprising a second cathode and a second anode positioned within a second evacuated enclosure, the second x-ray tube mounted on the mounting plate and configured to emit a second primary x-ray signal into the gantry through the aperture along a second predetermined path and having a second predetermined energy level; and first and second interlocking beam shields configured to position the first x-ray tube with respect to the second x-ray tube on the mounting plate such that the position of the first x-ray tube and the second x-ray tube are adjustable with respect to one another.

13. The system as recited in claim 12, further comprising:

a conveyor belt generally passing through the rotatable gantry.

14. The system as recited in claim 13, wherein a first focal spot of the first anode and a second focal spot of the second anode are aligned to the gantry mounting plate in a manner to match a helical path created by rotation of the gantry and motion of an object positioned on the conveyor belt.

15. The system as recited in claim 12, wherein the x-ray detector comprises a solid state flat panel x-ray digital detector.

16. The system as recited in claim 12, wherein:

the first x-ray tube is further configured to emit a first reference x-ray through the aperture; and the second x-ray generating source is further configured to emit a second reference x-ray signal through the aperture.

17. The system as recited in claim 16, further comprising:

a first reference detector at least partially positioned within the rotatable gantry so as to be impinged upon by the first reference x-ray; and a second reference detector at least partially positioned within the rotatable gantry so as to be impinged upon by the second reference x-ray.

18. The system as recited in claim 12, wherein the first predetermined path and the second predetermined path overlap such that the x-ray detector is fully covered by each of the first and second primary x-ray signals.

19. The system as recited in claim 12, further comprising a collar shield positioned between the first and second interlocking beam shields and the rotatable gantry.

20. The system as recited in claim 12, wherein:

the first interlocking beam shield comprises a male portion; and the second interlocking beam shield comprises a female portion configured to removably receive the male portion.

* * * * *

UNITED STATES PATENT AND TRADEMARK OFFICE

CERTIFICATE OF CORRECTION

PATENT NO. : 7,476,023 B1
APPLICATION NO. : 11/460581
DATED : January 13, 2009
INVENTOR(S) : Canfield et al.

It is certified that error appears in the above-identified patent and that said Letters Patent is hereby corrected as shown below:

Column 4
Line 66, change "14" to --14 (FIG. 1)--

Column 5
Line 32, change "11, 13" to --11, 13 (FIG. 1)--

Column 7
Line 20, change "52" to --52 (FIG. 2)--

Column 8
Line 25, change "20" to --20 (FIG. 2)--
Line 38, change "beam shield is" to --beam shield 160 is--
Line 56, change "mounting plate and" to --mounting plate 22 and--

Column 9
Line 25, change "30, 32" to --30, 32 (FIG. 2)--
Line 28, change "30, 32" to --30, 32 (FIG. 2)--

Column 11
Line 1, Claim 3, change "sources" to --source--

Signed and Sealed this

Tenth Day of August, 2010

David J. Kappos

David J. Kappos
*Director of the United States Patent and Trademark Office*